United States Patent [19]

Rotenberg et al.

[11] 3,950,164

[45] Apr. 13, 1976

[54] ALUMINIUM-BASED ALLOY

[76] Inventors: Vladimir Adolfovich Rotenberg, Zelenodolskaya ulitsa, 10/14, kv. 29; Kira Markovna Khruschova, Leningradsky prospekt, 88, korpus 1, kv. 10; Jury Yakovlevich Zilberg, 4 Grazhdanskaya ulitsa, 37, korpus 1, kv. 34; Anzhelika Petrovna Begidzhanova, Verkhaaya ulitsa, 18, Kv. 37; Anatoly Sergeevich Gulyaev, Schelkovskoe shosse, 77, korpus 2, kv. 3; Irina Vladimirovna Protasova, ulitsa Miklukho-Maklaya, 51, korpus 1, kv. 86, all of Moscow; Alexei Ivanovich Shapochkin, ulitsa Korova, 5, Mikhailovsk Sverdlovskoi oblasti; Vladislav Ivanovich Pavlov, Polynkovskaya ulitsa, 17, Tambov; Eduard Sergeevich Mirakov, Leningradskoe shosse, 7/2, korpus 2, kv. 63; Arseny Emelyanovich Izotov, Mironovskaya ulitsa, 9, kv. 78, both of Moscow; Ivan Alexandrovich Serikov, ulitsa Dzerzhinskogo, 64, kv. 3; Not Vasilievich Ignatiev, ulitsa Kosmonavtov, 2, kv. 7, both of Kharkov, all of U.S.S.R.

[22] Filed: May 10, 1974

[21] Appl. No.: 469,023

[30] Foreign Application Priority Data

May 10, 1973 U.S.S.R. ..... 1921777

[52] U.S. Cl. ..... 75/138; 75/139; 75/140; 75/147; 148/32

[51] Int. Cl.[2] ..... C22C 21/00

[58] Field of Search ..... 75/138, 139, 140, 147; 148/32, 32.5

[56] References Cited

UNITED STATES PATENTS

| | | | |
|---|---|---|---|
| 2,215,442 | 9/1940 | Vaders | 75/138 |
| 3,773,501 | 11/1973 | Nakajima et al. | 148/32 |

*Primary Examiner*—R. Dean
*Attorney, Agent, or Firm*—Holman & Stern

[57] ABSTRACT

An alloy containing between 2.0 and 8.0 wt % of antimony; at least one element selected from a group consisting of copper, nickel, chromium, titanium and taken in a total amount of between 0.2 and 3.0 wt %; at least one element selected from a group consisting of sulphur, selenium, tellurium, phosphorus, arsenic and taken in a total amount of between 0.005 and 0.5 wt %, with the balance being aluminium. Said alloy is particularly adapted for the fabrication of bimetallic shells of journal bearings.

5 Claims, No Drawings

ALUMINIUM-BASED ALLOY

The present invention relates to aluminium-based alloys used in the fabrication of bimetallic shells of heavy-duty journal bearings such as those, for example, which are found in both stationary and automotive (tractor and automobile) diesel engines, compressors and other machinery where the maximum pressure per unit area of the bearing is no greater than a specific limit of from 400 to 450 kg/cm$^2$ and not over.

Since in the manufacture of bimetallic shells the aluminium alloy is exposed to considerable deformations, a plasticity requirement must be met by the alloy which is sufficiently high to assure the cladding of steel with said alloy.

An aluminium-based alloy is known in the art, which contains between 0.5 and 7.0 wt % of stibium, along with other possible components such as copper and nickel present in an amount of between 2 and 12 wt % of the total, or with each taken separately, as well as with one or more of a metal selected from a group consisting of manganese, titanium and chromium. However, the use of such an alloy for industrial applications invites difficulties because the alloy contains no modifying additives facilitating the formation of a fine-grained aluminium/antimony component structure of the alloy (AlSb phase), and this fact poses problems in working (rolling) the alloy due to its poor plasticity, and renders it impossible in the cladding of steel with said alloy.

Aluminum-based alloys enjoy a wide-spread application in tractor engine engineering which alloy containing between 3.5 and 6.5 wt % of antimony, between 0.3 and 0.7 wt % of magnesium, with the balance being aluminium. This alloy lends itself readily to mechanical working but contains no strengthening elements such as copper, nickel and the like, and for this reason fails to meet modern requirements as to the fatigue strength, and the seizure resistance which are of a high order of importance for materials used in bearings, for instance. By way of illustration, shells clad with said bearing alloy cannot withstand unit pressures in excess of 200 kg/cm$^2$, whereas in modern turbo-charged tractor engines this pressure is of an order of 300 kg/cm$^2$ and higher.

Among other aluminium-based bearing alloys used in modern engine engineering, it is worth mentioning the widely used alloys containing tin in an amount of 20 % and upwards. Alloys belonging to said family assures servicability of the bearing shells in diesel engines at unit pressures of not over 320 kg/cm$^2$ apart from the fact that they are costly materials.

It is therefore an object of the present invention to eliminate the above disadvantages.

Another object of the present invention is to provide a tinless aluminium-based alloy which assures high fatigue strength combined with resistance to seizing.

A further object of the present invention is to provide a tinless alloy displaying good workability which enables its cladding with steel without difficulty.

Said and other objects are attained by the fact that an aluminium-based alloy composed of stibium and copper and/or nickel, and/or chromium, and/or titanium, and in addition, according to the invention, contains components such as sulphur, and/or selenium, and/or tellurium, and/or phosphorus, and/or arsenic in an amount of between 0.005 and 0.5 wt % with the balance being aluminium.

All of said compositions feature an optimum combination of fatiuge strength, resistance to seizing, and workability.

The introduction of one or more of an element from the group consisting of sulphur, selenium, tellurium, phosphorus, and arsenic into the alloy in an amount of less than 0.005 % fails to produce a modifying effect because the particles of the AlSb phase do not diminish in size. On the other hand, an addition of said elements in an amount exceeding 0.5 % does not bring about the desired decrease in the size of the AlSb phase particles, aside from the fact that overmodification is a frequent occurence in such cases.

Also in accordance with the invention, the antimony should be contained in the alloy in an amount of between 2.0 and 8.0 wt % whereas the aggregate content of copper, and/or nickel, and/or chromium, and/or titanium, is between 0.2 and 3.0 wt %.

The optimum concentration of a modifying component varies with the composition of the alloy, increasing with an increase in the antimony content of alloy and decreasing with the rate at which the ingot is cooled during crystallization thereof.

Alloys having an antimony content of under 2 % are likely to be seized more frequently and those containing antimony in an amount exceeding 8 % display poor plasticity, thus posing problems when rolling the alloy and when cladding steel therewith.

The doping of the alloy with one or more of the elements selected from the group consisting of copper, nickel, chromium and titanium taken in an amount of under 0.2 % gives no appreciable increase in the strength of alloy, whereas the addition of said elements in an amount exceeding 3% brings about excess brittleness of the alloy, thereby inviting difficulties in rolling and cladding the alloy with steel.

Below will be found several examples illustrating preferred embodiments of the invention.

EXAMPLE 1

An aluminum alloy containing 6 % of antimony, 2 % of copper, 0.2 % of titanium and 0.005 % of phosphorus was melted molten in an induction high-frequency furnace and cast into a castiron mould. Metallographic studies had revealed that about 40 % of the primary AlSb crystals were of compact polyhedral shape and averaged 15 microns in size. The rest of crystals were coarse needles some 200 microns long which are characteristic of unmodified alloys; this is an indication that the modification was an incomplete one.

Similar results were obtained when an alloy containing 6 % of antimony, 2 % of copper and 0.2 % of titanium additionally contained S, Se, Te and As taken in an amount of 0.005 %. In all the above cases only a partial modification of the structure was observed accompanied by the partial transformation of needle-shaped AlSb crystals into compact polyhedral crystals.

EXAMPLE 2

An aluminum alloy containing 5 % of antimony, 1 % of copper, 0.4 % of chromium and 0.15% of titanium was additionally alloyed with 0.2 % of selenium. Metallographic studies revealed that around 90 % of primary AlSb crystals were of a compact form averaging 8 microns in size, whereas the remaining 10 % of primary AlSb crystals were needles of up to 30 microns in length.

EXAMPLE 3

An alloy containing 6 % of antimony, 1 % of copper, 1 % of chromium and 0.1 % of titanium was additionally alloyed with 0.5 % of tellurium. Metallographic studies show that 100% of the primary AlSb crystals were polyhedrons averaging 5 microns in size and distributed uniformly throughout the matrix of alloy.

EXAMPLE 4

An alloy containing 4 % of antimony, 0.5 % of copper, 1 % of nickel and 0.5 % of chromium was additionally alloyed with 0.3 % of tellurium and 0.1 % of sulphur. The size, shape and pattern of distribution of the primary AlSb crystals were close to those observed in Example 2.

EXAMPLE 5

Ingots of an alloy containing 8 % of antimony, 1 % of copper and 0.2 % of tellurium were hot-rolled and cold-rolled. The studies of the strips produced therefrom reveal that the alloy of said composition displayed increased brittleness, and the ingots tended to crack, particularly when being cold-rolled. A further increase in the antimony content renders the alloy difficult to roll. The same phenomenon was observed when the amount of the strength-improving elements (Cu, Ni, Cr and Ti) exceeded 3 % in the alloy.

EXAMPLE 6

Alloys containing 2 % of antimony, 0.2 % of Cu, 0.2 % of Ni and 0.2 % of Cr were melted in an induction high-frequency furnace. The microhardness number of the alloy ground under a load of 10 g was on the order of between 38 and 42 kg/mm², thus indicating that the effect of strengthening was inadequate (the microhardness number of an alloy containing 2 % of antimony, 0.1 % of selenium and no additives in the form of Cu, Ni and Cr averages 35 kg/mm².

Apart from that, metallographic studies reveal that the number of the primary AlSb crystals in the structure of said alloy is very small because the alloy is almost an eutectic one in terms of the antimony content (corresponding to the eutectic point in a binary Al-AlSb system with a antimony content of 1.1 wt %). With a further decrease in the antimony content, the primary AlSb crystals disappear altogether and this increases the tendency of alloys to seizing.

EXAMPLE 7

An unmodified alloy was prepared having an antimony content of 4.3 % referred to hereinafter as alloy No. 1, as well as an alloy containing antimony in the same amount (4.3 %), but further modified by adding tellurium in an amount of 0.015 wt % referred to hereinafter as alloy No. 2. The two alloys were tested for mechanical properties the results of which are given in Table 1.

Table 1

| Alloy | BHN | $a_k$, kgm/cm² | δ, % | ψ, % | $\Sigma_b$, kg/mm² |
|---|---|---|---|---|---|
| No. 1 | 32 | 0.38 | 5.8 | 6.9 | 7.9 |
| No. 2 | 32 | 0.75 | 17.2 | 30.0 | 8.9 |

where BHN = Brinell hardness number;
$a_k$ = impact strength of notched specimens;
δ = elongation at break;
ψ = reduction of area;
Σ = ultimate tensile strength.

As can be seen from Table 1, the modification of the alloys of the Al-Sb system was accompanied by a sharp increase in the impact strength, an increase in the elongation at break, and a reduction of area while the hardness and strength of the alloys remained virtually unchanged. In alloys of the Al-Sb system, additionally doped by introducing Cu, Ni, Cr and Ti, with the effect of the modification on machanical properties being a pronounced one.

EXAMPLE 8

An unmodified alloy was prepared (referred to hereinafter as alloy No. 3) containing 4.75 wt % of antimony, 0.94 wt % of copper, 0.11 wt % of titanium, with the balance being aluminium, and a modified alloy (referred to as alloy No. 4) containing 4.61 wt % of antimony, 0.74 wt % of copper, 0.07 wt % of titanium and 0.13 wt % of phosphorus, with the balance being aluminium. The two alloys were tested for mechanical properties the results of which are tabulated in Table 2.

Table 2

| Alloy | As cast | | | | After rolling and annealing (incomplete recrystallization) | | | |
|---|---|---|---|---|---|---|---|---|
| | $\Sigma_b$, kg/mm² | ψ,% | δ,% | $a_k$, kgm/cm² | $\Sigma_b$, kg/mm² | ψ,% | δ,% | $a_k$, kgm/cm² |
| No. 3 | 9.5 | 4 | 2 | 0.9 | 11.8 | 26 | 22 | 2.3 |
| | 1.6 | 60 | 45 | 2.3 | 1.5 | 90 | 55 | 4.2 |
| No. 4 | 11.3 | 33 | 23 | 1.4 | 11.0 | 18 | 14 | 3.0 |
| | 1.5 | 70 | 35 | 2.7 | 1.5 | 90 | 55 | 4.7 |

Footnote:
Above the line the values obtained at room temperature are given and below the line, those obtained at a temperature of 500°C.

Table 2 illustrates the fact that in spite of a lower amount of the doping components present in alloy No. 4, this alloy displays mechanical properties which are superior to those characteristic of the unmodified alloy No. 3, particularly in the as cast condition. Rolling of the alloys leads to the AlSb particles being crashed and consequently virtually equates the mechanical properties of both the unmodified and modified alloys. Rolling of the unmodified No. 3 alloy was accompanied by severe fracturing of the ingot, whereas the No. 4 alloy was rolled without any difficulties.

EXAMPLE 9

An alloy containing 4.1 wt % of antimony 0.84 wt % of copper, 0.37 wt % of chromium, 0.16 wt % of titanium and 0.06 wt % of tellurium was heat-treated and worked in a variety of ways. The change of the mechanical properties are given in Table 3 (the alloy is referred to hereinafter as alloy No. 5).

Table 3

| Condition | BHN | $\Sigma_3$, kg/mm² | $\Sigma_{0.2}$, kg/mm² | δ,% | ψ,% | $a_k$, kgm/cm² |
|---|---|---|---|---|---|---|
| As cast | 40 | 12.8 | 8.0 | 14.0 | 20.0 | 1.0 |
| Cold-rolled | 72 | 22.1 | 21.6 | 3.7 | — | — |
| 1 | 2 | 3 | 4 | 5 | 6 | 7 |
| Recrystallized | 39 | 14.6 | 6.1 | 27.0 | — | — |

where $\Sigma_{0.2}$ = yield strength (0.2 % offset)

It will be noted from the above Table that the alloy exceeds in strength all bearing alloys used in engine engineering on an industrial scale.

EXAMPLE 10

An alloy, referred to hereinafter as alloy No. 6, containing 5.0 wt % of antimony, 0.9 wt % of copper, 0.15 wt % of titanium, 0.06 wt % of tellurium, with the balance being aluminium, was melted in an induction high-frequency furnace. The mechanical properties of the alloy are given in Table 4.

Table 4

| Properties | Mechanical Properties of No. 6 Alloy Condition | | |
|---|---|---|---|
| | As cast | Cold-rolled | Recrystallized |
| $\Sigma_b$, kg/mm² | 11.6 | 19.6 | 13.2 |
| 1 | 2 | 3 | 4 |
| $\Sigma_{0.2}$, kg/mm² | 7.7 | 18.9 | 6.4 |
| δ, % | 16.8 | 7.0 | 27.5 |
| ψ, % | 21.1 | — | 25.5 |
| $a_k$, kgm/cm² | 1.6 | — | 2.4 |
| BHN | 35 | 60 | 34 |

where $\Sigma_{0.2}$ = yield strength (0.2 % offset)

The alloy was cast, using the semi-continuous process, into a chrome-plated copper mould, and then a bimetal was obtained from the alloy by rolling it in conjunction with steel. Shells, made from the bimetal so produced, were 84 mm in diameter were used for crankpin bearings of diesel engines.

For evaluating the fatigue strength and seizing properties of the alloy according to the invention in comparison with known alloys, tests were undertaken using shells made of the above disclosed No. 6 alloy, and the following alloys : No. 7 alloy containing 3.5 wt % of antimony and 0.7 wt % of magnesium, and the balance being aluminium; No. 8 alloy containing 1.0 wt % of copper, 0.1 wt % of titanium, 20 wt % of tin, with the balance being aluminium; No. 9 alloy containing 1.0 wt % of copper, 0.1 wt % of titanium, 6.0 wt % of tin, and 1.0 wt % of nickel, with the balance being aluminium; No. 10 alloy containing 1.0 wt % of copper, 0.1 wt % of titanium, 9.0 wt % of tin, with the balance being aluminium.

The shells from the above alloys were tested on a special engineless test stand under the conditions of shock loads applied in oil at an elevated temperature. The results of these test are given in Table 5.

Table 5

| Alloy Ref. No. | Relative fatigue strength |
|---|---|
| No. 7 | 1 |

Table 5-continued

| Alloy Ref. No. | Relative fatigue strength |
|---|---|
| No. 8 | 1.29 |
| Nos. 9 and 10 | 1.38 |
| Nos. 4 and 6 | 1.43 |

Table 5 vividly illustrates that the shells made from the No. 6 alloy compare favourably with the rest of shells in terms of fatigue strength.

The relationship between the relative fatigue strength given in Table 5 and the limiting values of bearing stresses is not a linear one for the alloys tested; e.g. for the Nos. 4 and 6 alloys, the absolute value of the limiting stress is around 350 kg/cm² compared with from 300 to 320 kg/cm² characterized by the known Nos 9 and 10 alloys, with a tin content of between 6 and 9 %.

The specimens, i.e., the shells, made of bimetal incorporating bearing alloys Nos. 4 and 6 through 10 were tested in order to compare their resistance to seizing under extremely heavy conditions of boundary lubrication using a special test stand. The tests have revealed that in terms of the resistance to seizing, the disclosed alloys Nos. 4 and 6 not only make a better showing than the known tinless alloy No. 7 but have an edge over the known alloys having a tin content of between 6 and 9 % (Nos. 9 and 10), with their being inferior only to the alloy containing 20 % of tin (No. 8).

Comparative studies of bimetallic shells made of the disclosed bearing alloys Nos. 4 and 6 and of shells using the known aluminium-based alloy No. 8 containing 20 % of tin and 1 % of copper, were undertaken at the same time with the shells of both kinds being installed on the same Diesel Engine operating under design loads as high as from 550 to 600 kg/cm² on the bearing in shells. The conclusions drawn from the results of these studies are that the disclosed alloys Nos. 4 and 6 run-in with ease, display no tendency to seizing, and exhibit a fatigue strength which is higher than that of the known aluminium-based tin alloy No. 8 (shells in the known No. 8 alloy backed by steel showed a network of cracks and cavities due to fatigue after 100 hours of testing, whereas the surface of the shells in the alloys disclosed was free from defects).

It is thus obvious that the extensive tests of alloys according to the invention are proof that said alloys are superior to all known aluminium-based bearing alloys used on an industrial scale in terms of fatigue strength and which are inferior only to the expensive alloy containing 20 % of tin as far as the resistance to seizing is concerned. The tests have also revealed that additional doping of the alloy with additives consisting of chromium and/or nickel is conducive to further increase in fatigue strength.

In the light of the tests undertaken it stands to reason that the aluminium-based bearing alloy in accordance with the invention is of special importance as a material for bimetallic shells of journal bearings used in heavy-duty engines, and is a suitable substitute for the aluminium-based tin alloys. An additional advantage of the bearing alloys based on the Al-Sb system according to the invention is the fact that, as proven by tests, said alloys can be used in shells of bimetallic construction without a running-in over coating.

What is claimed is:

1. An aluminium-based alloy consisting essentially of antimony in an amount between 2.0 and 8.0 wt %; and at least one element selected from the group consisting of copper, nickel, chromium, and titanium taken in a total amount of between 0.2 and 3.0 wt %; at least one element selected from the group consisting of sulphur, selenium, tellurium, phosphrus, and arsenic, taken in total amount between 0.005 and 0.5 wt %, with the balance being aluminum.

2. The alloy as claimed in claim 1, wherein the alloy consists essentially of aluminum, titanium, antimony, copper, and phosphorus.

3. The alloy as claimed in claim 1, wherein said alloy consists essentially of aluminum, antimony, copper, chromium, titanium, and selenium.

4. The alloy as claimed in claim 1, wherein said alloy consists essentially of aluminum, antimony, copper, nickel, chromium, and tellurium.

5. The alloy as claimed in claim 1, wherein said alloy consists essentially of aluminum, antimony, copper, and tellurium.

* * * * *